US009015917B2

(12) United States Patent
Norton

(10) Patent No.: US 9,015,917 B2
(45) Date of Patent: Apr. 28, 2015

(54) CLAMPING AND GRIPPING DEVICE WITH HIGH MECHANICAL ADVANTAGE AND ENERGY SAVING ATTRIBUTES

(76) Inventor: Daniel A. Norton, Cary, NC (US)

( * ) Notice: Subject to any disclaimer, the term of this patent is extended or adjusted under 35 U.S.C. 154(b) by 256 days.

(21) Appl. No.: 13/506,905

(22) Filed: May 23, 2012

(65) Prior Publication Data

US 2013/0312247 A1 Nov. 28, 2013

(51) Int. Cl.

| | |
|---|---|
| ***B25B 27/00*** | (2006.01) |
| ***B25B 5/00*** | (2006.01) |
| ***B25B 5/10*** | (2006.01) |
| ***B25B 5/12*** | (2006.01) |

(52) U.S. Cl.

CPC ..... *B25B 5/003* (2013.01); *B25B 5/101* (2013.01); *B25B 5/125* (2013.01); *Y10T 29/49998* (2015.01)

(58) Field of Classification Search

USPC ..... 29/270, 271, 276, 281.1, 281.3, 281.4; 83/404, 412, 454, 569

See application file for complete search history.

(56) References Cited

U.S. PATENT DOCUMENTS

| | | | | |
|---|---|---|---|---|
| 172,347 | A | 1/1876 | Shedlock | |
| 3,142,868 | A | 8/1964 | Blount | |
| 6,971,296 | B2 * | 12/2005 | Lin et al. | 83/404 |
| 2010/0224310 | A1 | 9/2010 | Jones | |

* cited by examiner

*Primary Examiner* — Richard Chang

(57) ABSTRACT

A tool is provided for moving a first clamping or gripping member toward or away from a second facing clamping or gripping member, the tool having a double threaded drive shaft coupled to opposed threaded linkage driving members for causing the threaded linkage driving members to be driven toward or away from each other. As the threaded linkage driving members move closer, the resulting angle of the links becomes steeper, thus increasing the mechanical advantage of the clamping tool, enhancing clamping forces. A beneficial result is a clamping apparatus that requires less manual energy than a traditional clamp. Another beneficial result is provided if the same amount of energy is applied to the driveshaft as in a traditional clamp, the resulting clamping force is significantly higher. If the second clamping member is adjustable, it accommodates wide variations in thickness of an object positioned between the first and second clamping members.

11 Claims, 5 Drawing Sheets

CLAMPING AND GRIPPING DEVICE WITH HIGH MECHANICAL ADVANTAGE AND ENERGY SAVING ATTRIBUTES

BACKGROUND OF THE INVENTION

I determined that it would be beneficial for a user to substantially increase the force exerted against a work piece by a c-clamp. This would also mean that less muscular effort would be needed by a user to obtain a satisfactory clamping force while saving energy to operate which could aid the handicapped worker. Also I have designed an automated clamping device that calls for a significantly smaller motor to exert the same clamping force. This will save money and energy for equipment designers.

BRIEF SUMMARY OF PREFERRED EMBODIMENTS OF THE INVENTION

A clamping or gripping device includes a double threaded drive shaft operating opposable threaded linkage driving members that in turn drive sets of linkages inward toward the clamping direction. As the threaded linkage driving members are driven toward each other, they actuate links that in turn push a clamping or gripping plate upward to clamp material between itself and an opposing facing clamping or gripping surface. As the threaded linkage driving members move closer, the resulting angle of the links becomes steeper, thus increasing the mechanical advantage of the clamping or gripping device, enhancing clamping or gripping forces against an object e.g. a work piece. A beneficial result is a clamping apparatus that requires significantly less muscular energy to operate than a traditional c-clamp that can help the handicapped user. Another beneficial result is that if the same amount of muscular energy is applied to the driveshaft as in connection with a traditional c-clamp, the resulting clamping force is significantly higher, aiding in such operations as shearing and punching.

A preferred embodiment also then permits the linkages to toggle over center and lock the device in place. This is an added safety benefit for the clamp in that the device will resist excessive vibration, or accidental bumping of the driveshaft handle.

Tools of the invention can be configured with multiple embodiments, and can be used for many applications such as holding parts for fabrication, gripping, or even cutting, shearing or punching material. Another application is manual or robotic spot welding. The resulting very high application forces is a substantial benefit for these operations, particularly punching and shearing. For workbench applications it can be used in place of traditional c-clamps to require less effort to clamp parts together that can aid the handicapped. For gripping or lifting applications it can be attached to a gantry or robot arm and operated via a motor to achieve significantly higher clamping or gripping forces when compared to standard screw-drive actuators or grippers. Thus, the double threaded drive shaft and link assembly enables the clamping plate to have a higher resulting force against any fixed opposing surface.

DETAILED DESCRIPTION OF PREFERRED EMBODIMENTS OF THE INVENTION

Figure 1A:
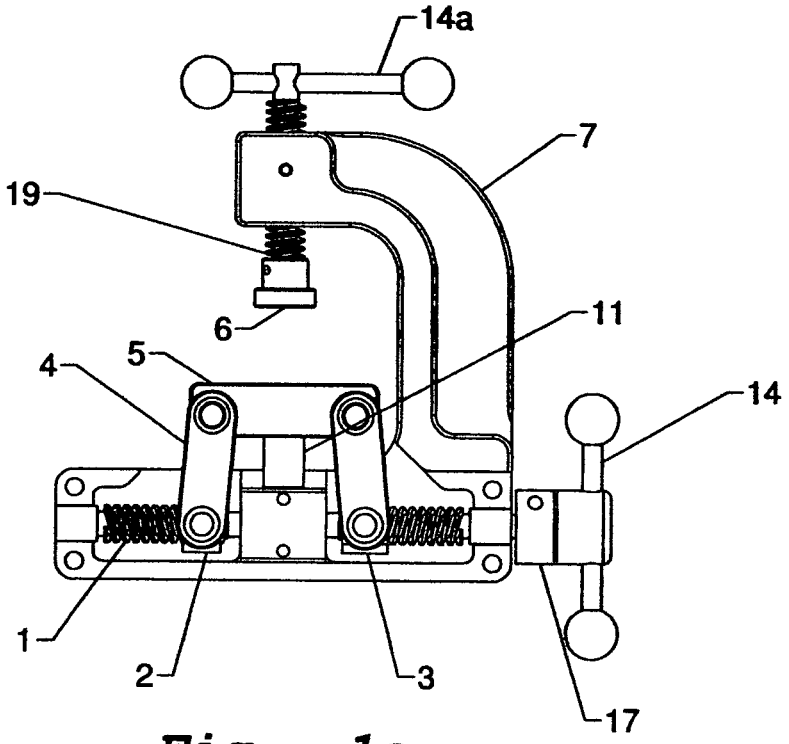
FIG. 1*a* Is a side elevation of the device, with cover plate removed, and with clamp assembly shown with the clamping plate nearly fully extended. The links are shown at a very steep angle so as to illustrate the higher mechanical advantage of the assembly.
Figure 1B:
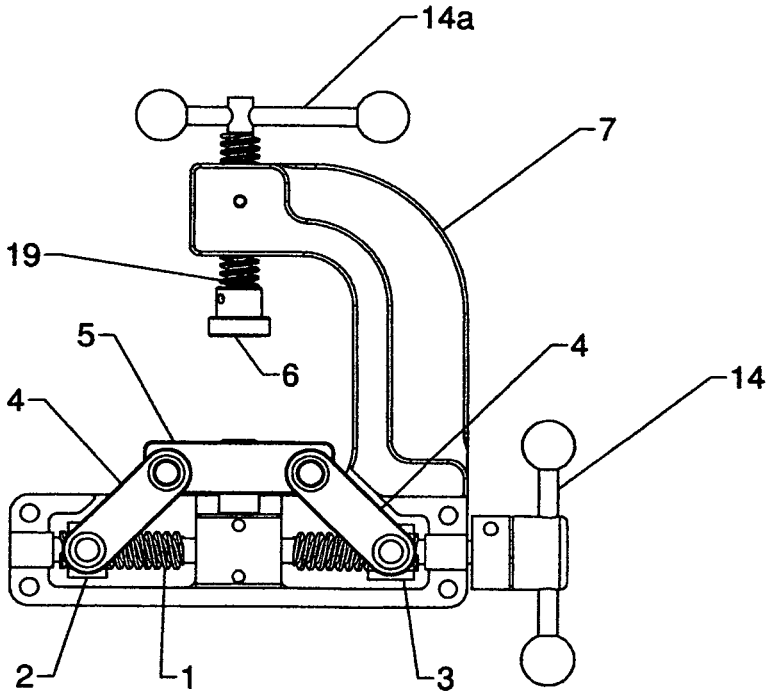
FIG. 1*b* Is the same side elevation as in FIG. 1*a*, but the clamp assembly is shown with the clamping plate fully retracted. The links are shown at a shallow angle and the threaded linkage driving members shown at their maximum distance from each other.

As shown in FIGS. 1*a* and 1*b*, a double threaded driveshaft 1 features a right handed thread and a left handed thread that engages corresponding right handed and left handed threaded linkage driving members 2 and 3.

Figure 4:
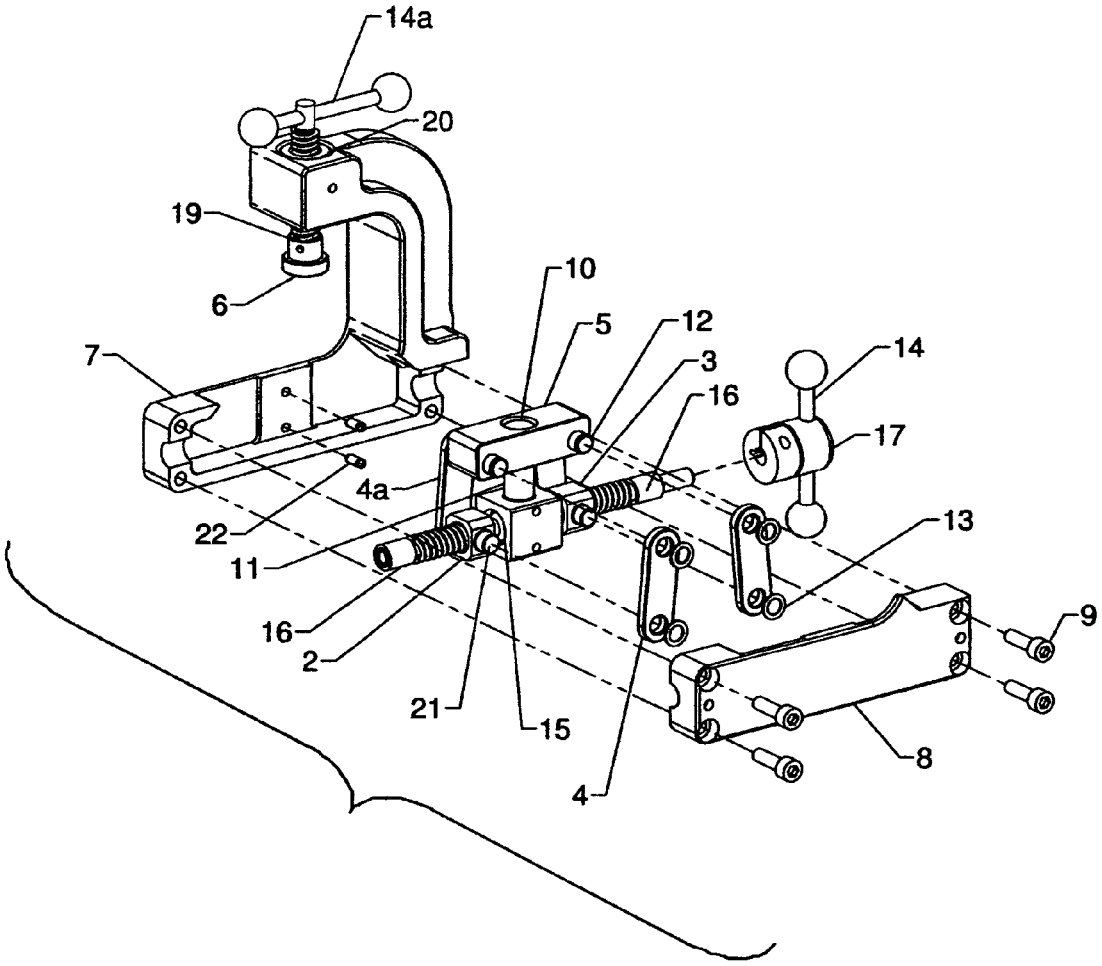
FIG. 4 is a fully exploded view of the preferred embodiment shown in FIGS. 1 through 3.

As shown in FIG. 4, the double threaded driveshaft can be supported at its center by a bushing or bearing 15, and can be supported at either or both ends by bushings or bearings 16. As torque is applied to the driveshaft 1, by the manual operation of rotary handle 14, the driveshaft will rotate, causing the threaded linkage driving members 2 and 3 to move toward or away from each other. The threaded linkage driving members are attached to a set of four links 4 and 4*a* either by retaining rings 13 or some other means. The links are attached to clamping plate 5. The link ends can be attached directly to the threaded linkage driving members via pivot shafts 21 or through the use of separate pivot shafts 12 all as shown in FIG. 4.

As shown in FIG. 4, the clamping plate 5 can feature a center hole 10 that is slidable along a center guide shaft 11. In the preferred embodiment, the guide shaft 11 is employed, and serves to keep the clamping plate 5 centered as it is actuated from the fully unclamped to the fully clamped position. The center guide shaft also serves to force both threaded linkage driving members 2 and 3 to move at the same rate and keep both sets of links 4 and 4*a* at equivalent angles. In the preferred embodiment, the center guide shaft 11 is machined with a set of dowel holes that receive dowel pins 22 of FIG. 4, that enable proper assembly placement onto the main housing 7.

The center guide shaft 11 may not be required in all applications. In fact it may be advantageous to omit the center guide shaft feature in order to gain more adjustability in clamping material at varying angles and varying thicknesses.

Also, the clamping assembly can be configured such that the double threaded driveshaft 1 can be separated into right and left threaded rods that can be independently rotated from opposing ends, either manually or via motors.

In the case of the preferred embodiment, where the threaded linkage driving members are moving toward each other, the links are forced into a steeper angle with respect to the driveshaft's axis. The steeper angle results in corresponding increasing mechanical advantage. This mechanical advantage results in the user being required to exert only a fraction of the amount of tightening torque when compared to similar devices, e.g. c-clamps, with standard single threaded rod actuators. This can benefit users that are physically handicapped.

Figure 2:
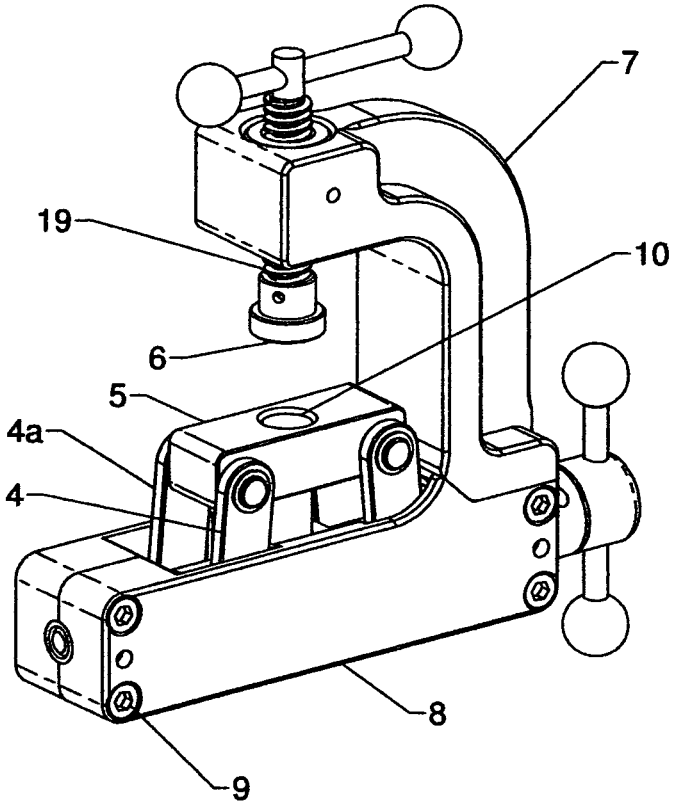
FIG. 2 is an isometric view of the preferred embodiment, with cover plate attached.
Figure 3:
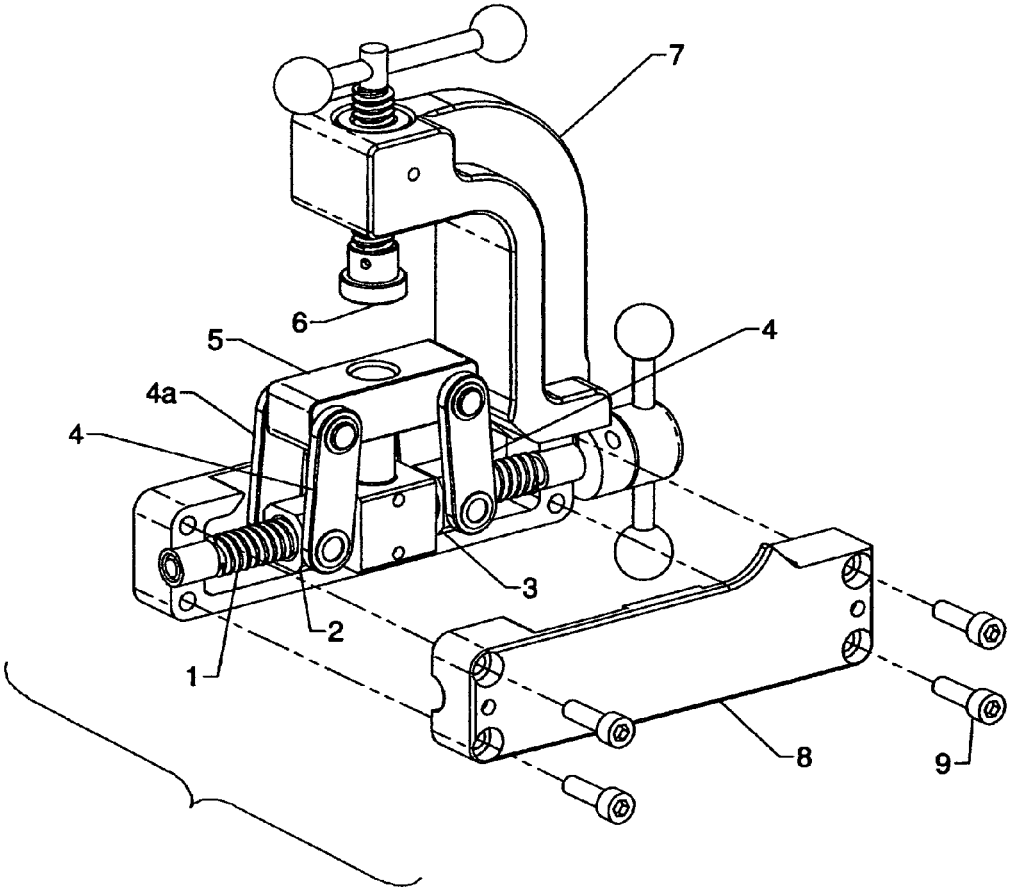
FIG. 3 is the same view as shown in FIG. 2 but with the cover plate and cover plate screws exploded.

The double threaded driveshaft 1 can be mounted inside a main clamp housing 7, and cover plate 8 and cover plate screws 9 shown in FIG. 2. The housing 7 shape and features can be further customized as needed to suit the application.

The double threaded driveshaft has an optional shaft adapter 17 and manual crank handle 14 attached thereto as shown in FIG. 1*a*.

The preferred embodiment also has an opposing clamping member 6 can be optionally attached to an adjustment threaded rod 19 and optional crank handle 14*a* shown in FIG. 1*a*. This feature allows for additional adjustment in clamping or gripping a larger variety of material thicknesses. FIG. 4 shows the adjustment threaded rod 19 optionally inserted into a threaded adapter 20. The threaded adapter 20 can be made from a different material than the main housing 7 which results in more options for optimizing the mechanical properties of the adjustment threaded rod 19.

Another way of characterizing the embodiment of the invention shown in FIGS. 1*a* and 1*b* is a modified traditional c-clamp having (a) a first clamping member 5 positioned over a base portion of the c-clamp and a head portion having a second facing clamping member 6;

(a) a double threaded drive shaft 1 having right and left handed threads 1 is rotatably coupled to opposed threaded linkage driving members 2 and 3 for causing the threaded linkage driving members to be driven toward or away from each other; and (b) a set of links 4 and 4*a* are coupled between said threaded linkage driving members and said first clamping member for moving said first clamping member toward said facing second clamping member upon rotation of said double threaded drive shaft for clamping material there-between.

Figure 5:
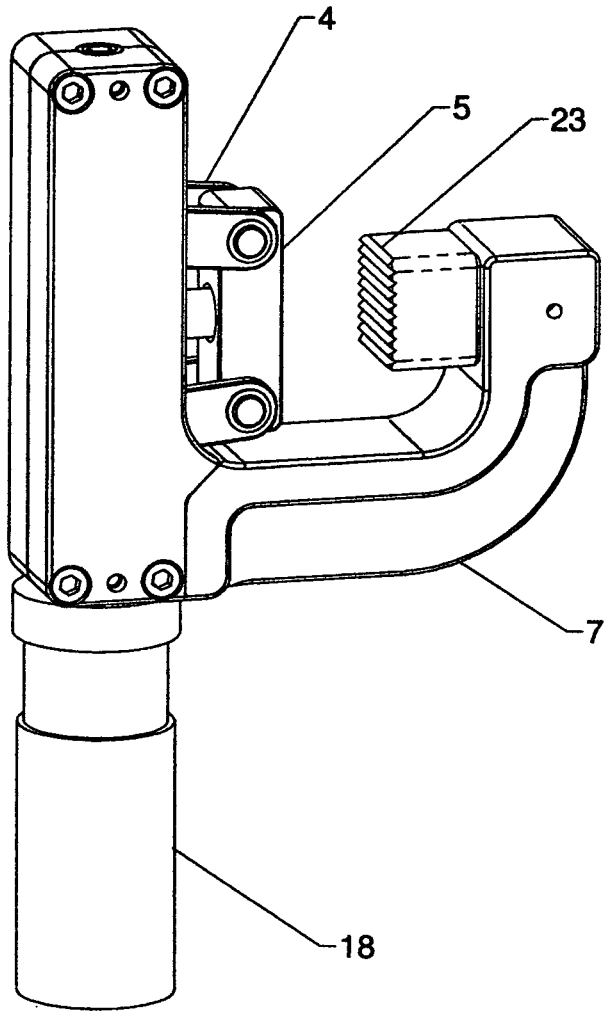
FIG. 5 is an isometric view of an alternate embodiment where a motor 18 is coupled to the clamp assembly in place of a manual crank handle. A fixed opposing gripping block is shown in place of an adjustable apposing clamping surface.

The embodiment shown in FIG. 5 employs an optional motor 18 directly coupled to the double threaded driveshaft 1 of FIGS. 1 and 2. A fixed opposing gripping block 23 is shown in place of the adjustable facing clamping member 6.

Further customization of the clamping or gripping device is easily attainable with the motorized assembly of FIG. 5. The double threaded drive shaft can be attached to a motor or actuator through the use of a wide variety of shaft coupling or transmission elements such as belt drives, chain drives, gear reducers, etc.

A set of attachment points can be added to the main housing of FIG. 5 for gantry and lifting applications for material handling. For example, a mounting flange and corresponding flange bolt pattern can be added to the main housing for robotic material handling applications.

Sensing elements can be added to the clamping/gripping device to enable part presence detection and clamping and unclamping states.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as indicated by the language of the following claims.

For example, the term "double threaded driveshaft" is intended to cover separate right handed and left handed threaded rods that can be independently rotated from opposing ends, either manually or via motors.

What is claimed is:

1. A clamping or gripping tool for moving a first tool component toward a facing second tool component comprising:

(a) a double threaded drive shaft having right and left handed threads rotatably coupled to opposed threaded linkage driving members for causing the threaded linkage driving members to be driven toward or away from each other;

(b) a set of links coupled between said threaded linkage driving members and said first tool component for moving said first tool component toward said second tool component upon rotation of said double threaded drive shaft for contacting objects there-between; and (c) wherein said first and second tool components comprise clamping or gripping members; and (d) including a rotary driver for rotating said double threaded drive shaft.

2. The tool of claim 1 including an adjustment member for adjusting the position of the second facing tool component relative to said first tool component for accommodating variations in thickness of a material positioned between the first and second tool components.

3. A c-clamp comprising:

(a) a first clamping member positioned upon a base portion of the c-clamp and a head portion having a second clamping member facing said first clamping member;

(b) a double threaded drive shaft having right and left handed threads rotatably coupled to opposed threaded linkage driving members for causing the threaded linkage driving members to be driven toward or away from each other; and (c) a set of links coupled between said threaded linkage driving members and said first clamping member for moving said first clamping member toward said facing second clamping member upon rotation of said double threaded drive shaft for clamping material there-between.

4. The c-clamp of claim 3 including an adjustment member for adjusting the position of said second clamping member relative to said first clamping member for accommodating variations in thickness of an object positioned between the first and second clamping members.

5. The c-clamp of claim 4 wherein a crank handle is rotatably coupled to the second clamping member.

6. The c-clamp of claim 3 wherein a crank handle is rotatably coupled to the double threaded drive shaft.

7. A clamping or gripping tool for moving a first tool component toward a second tool component comprising: the first tool component positioned upon a base portion of the clamp and a head portion having the second tool component facing the first tool component;

(a) a double threaded drive shaft having right and left handed threads rotatably coupled to opposed threaded linkage driving members for causing the threaded linkage driving members to be driven toward each other;

(b) a set of links coupled between said threaded linkage driving members and said first tool component for moving said first tool component toward said second tool component upon rotation of said double threaded drive shaft; and (c) wherein said first and second tool components comprise a pair of clamping or gripping members.

8. The tool of claim 7 including an adjustment member for adjusting the position of the second tool component relative to said first tool component for accommodating variations in thickness of a work piece positioned between said first and said second tool components.

9. The tool of claim 8 wherein a shaft is positioned within a hole formed within said first tool component serving to keep the first tool component centered as it is actuated from a fully unclamped position to a fully clamped position.

10. The tool of claim 7 wherein a shaft is positioned within a hole formed within said first tool component serving to keep the first tool component centered as it is actuated from a fully unclamped position to a fully clamped position.

11. A method of gripping an object comprising the step of:

(a) providing the clamping or gripping tool comprising: a double threaded drive shaft having right and left handed threads rotatably coupled to opposed threaded linkage driving members for causing the threaded linkage driving members to be driven toward or away from each other; and a set of links coupled between said threaded linkage driving members and said first clamping member for moving said first clamping member toward said facing second clamping member upon rotation of said double threaded drive shaft for clamping material therebetween; claim 7 that has first and second tool components;

(b) positioning an object between said first and second tool components; and (c) moving said first and second tool components relative to each other until said first and second tool component grip said object.

* * * * *